US006188008B1

(12) United States Patent
Fukata

(10) Patent No.: US 6,188,008 B1
(45) Date of Patent: Feb. 13, 2001

(54) CHORD INDICATION APPARATUS AND METHOD, AND STORAGE MEDIUM

(75) Inventor: Ayumi Fukata, Hamamatsu (JP)

(73) Assignee: Yamaha Corporation, Hamamatsu (JP)

( * ) Notice: Under 35 U.S.C. 154(b), the term of this patent shall be extended for 0 days.

(21) Appl. No.: 09/474,816

(22) Filed: Dec. 29, 1999

(30) Foreign Application Priority Data

Jan. 25, 1999 (JP) ..... 11-015717

(51) Int. Cl.[7] ..... G09B 15/00
(52) U.S. Cl. ..... 84/470 R; 84/485 R
(58) Field of Search ..... 84/470 R, 471 R, 84/485 R

(56) References Cited

U.S. PATENT DOCUMENTS 4,763,558 8/1988 Johnson, Jr. .
5,266,735 * 11/1993 Shaffer et al. ..... 84/470 R X
5,540,133 * 7/1996 Draper et al. ..... 84/485 R X
5,639,977 * 6/1997 Hesnan ..... 84/477 R

* cited by examiner

*Primary Examiner*—Jeffrey Donels
(74) *Attorney, Agent, or Firm*—Morrison & Foerster

(57) ABSTRACT

A chord indication apparatus and method and a storage medium are provided which enable the indication of string plucking positions for playing chords with plural kinds of stringed instruments. A ROM stores plural kinds of table data describing string plucking positions for a variety of chords with respect to said plural kinds of stringed instruments. A stringed instrument is designated, for which said string plucking positions should be indicated, among said plural kinds of stringed instruments. When a chord desired to be played is supplied, a CPU retrieves table data corresponding to the designated stringed instrument from the plural kinds of table data stored in the ROM, obtains string plucking positions corresponding to the supplied chord from the retrieved table data, and indicates the obtained string plucking positions.

17 Claims, 13 Drawing Sheets

KEYBOARD
1
KEY DEPRESSION DETECTING CIRCUIT
3
SWITCH INCLUDING POINTING DEVICE
2
SWITCH DETECTING CIRCUIT
4
DISPLAY UNIT
9
SOUD SOURCE CIRCUIT
15
EFFECT CIRCUIT
16
17
18
BUS
ROM
6
RAM
7
CPU
5
TIMER
8
FDD
10
20
HDD
11
CD-ROMD
12
21
MIDI I/F
13
100
ANOTHER MIDI EQUIPMENT
COMMUNICATION I/F
14
COMMUNICATION NETWORK
101
102
SERVER COMPUTER

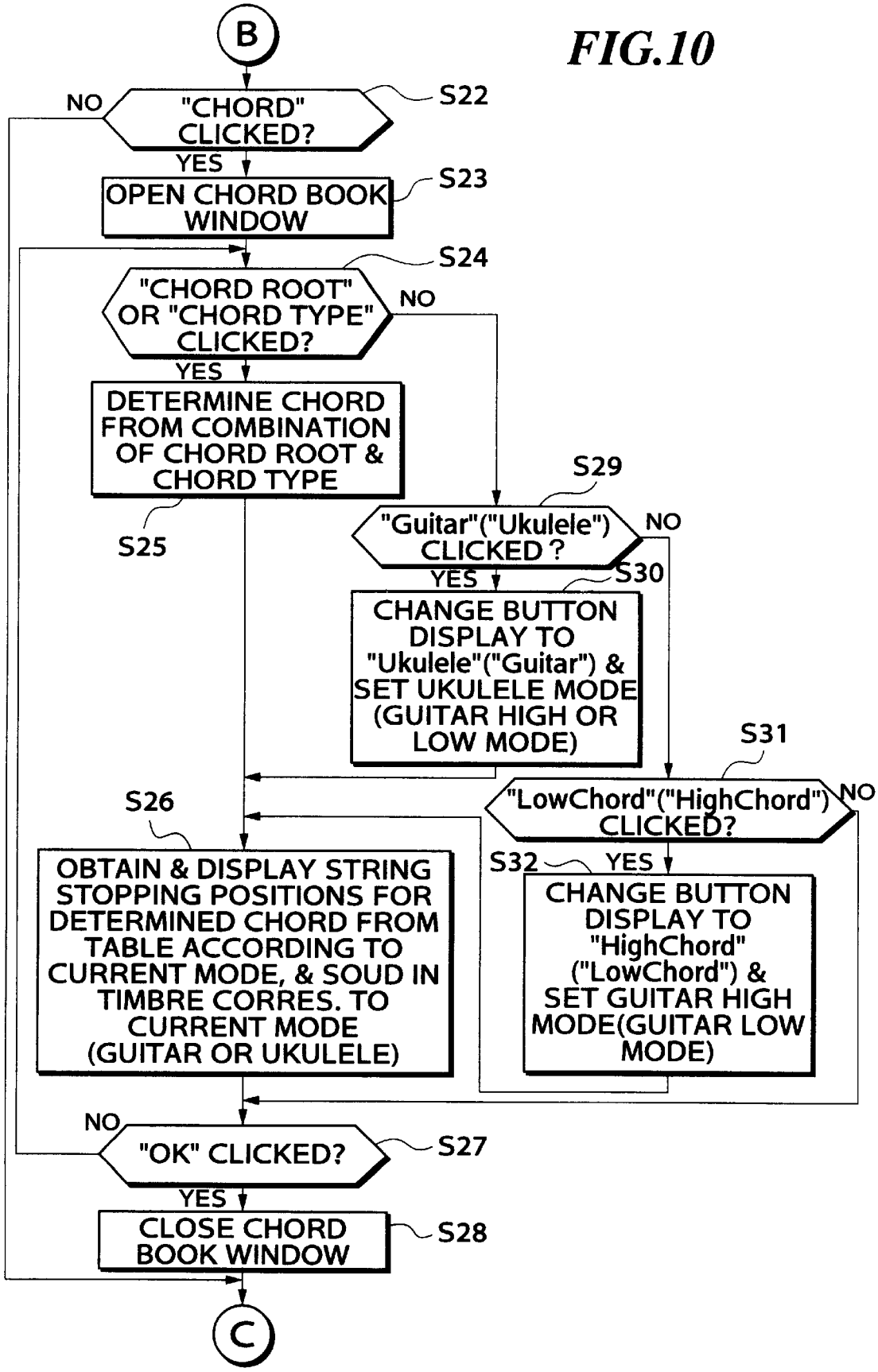
FIG.10
B
"CHORD" CLICKED?
S22
NO
YES
OPEN CHORD BOOK WINDOW
S23
S24
"CHORD ROOT" OR "CHORD TYPE" CLICKED?
NO
YES
DETERMINE CHORD FROM COMBINATION OF CHORD ROOT & CHORD TYPE
S25
S29
"Guitar"("Ukulele") CLICKED ?
NO
YES
S30
CHANGE BUTTON DISPLAY TO "Ukulele"("Guitar") & SET UKULELE MODE (GUITAR HIGH OR LOW MODE)
S31
"LowChord"("HighChord") CLICKED?
NO
S26
OBTAIN & DISPLAY STRING STOPPING POSITIONS FOR DETERMINED CHORD FROM TABLE ACCORDING TO CURRENT MODE, & SOUD IN TIMBRE CORRES. TO CURRENT MODE (GUITAR OR UKULELE)
S32
YES
CHANGE BUTTON DISPLAY TO "HighChord" ("LowChord") & SET GUITAR HIGH MODE(GUITAR LOW MODE)
NO
"OK" CLICKED?
S27
YES
CLOSE CHORD BOOK WINDOW
S28
C

CHORD INDICATION APPARATUS AND METHOD, AND STORAGE MEDIUM

BACKGROUND OF THE INVENTION

1. Field of the Invention

The present invention relates generally to a chord indication apparatus and method and a storage medium for indicating fingering or string stopping positions [hereinafter string stopping positions] for playing a chord with a stringed instrument, wherein the string stopping position refers to positions on fret(s) where fingers are to be placed on the fret(s) to stop strings.

2. Description of Related Art

There is known a chord indication apparatus that indicates string stopping positions for playing a chord with a stringed instrument. If a user selects a chord, the chord indication apparatus indicates string stopping positions in a stringed instrument corresponding to the selected chord, such as a guitar, and generates sound of the chord.

This conventional chord indication apparatus indicates the string stopping positions for playing the chord with respect to only one kind of stringed instrument, i.e., the guitar. Thus, a user cannot know the string stopping positions with respect to another stringed instrument for practice.

SUMMARY OF THE INVENTION

It is an object of the present invention to provide a chord indication apparatus and method and a storage medium that enable the indication of string stopping positions for playing chords with plural kinds of stringed instruments.

To attain the above object, according to a first aspect of the present invention, there is provided a chord indication apparatus which indicates string stopping positions for playing chords with plural kinds of stringed instruments, the apparatus comprising a storage device that stores plural kinds of table data describing string stopping positions for a variety of chords with respect to the plural kinds of stringed instruments, a designation device that designates a stringed instrument, for which the string stopping positions should be indicated, among the plural kinds of stringed instruments, a chord supply device that supplies a chord, and an indication device that retrieves table data corresponding to the stringed instrument designated by the designation device from the plural kinds of table data stored in the storage device, obtains string stopping positions corresponding to the chord supplied from the chord supply device from the retrieved table data, and indicates the obtained string stopping positions.

Preferably, the chord indication apparatus according to the first aspect further comprises a display device that displays a picture representing a fingerboard and strings of the designated stringed instrument, and wherein the indication device indicates string stopping positions for the supplied chord on the displayed picture representing the fingerboard and strings.

With the above arrangement of the chord indication apparatus according to the first aspect, string plucking positions for chords can be indicated with respect to a plural kinds of stringed instruments, so that the chords can be practiced effectively for those stringed instruments.

To attain the above object, according to a second aspect of the invention, there is provided a chord indication apparatus which indicates string stopping positions for playing chords with plural kinds of stringed instruments, the apparatus comprising a designation device that designates a stringed instrument, for which the string stopping positions should be indicated, among the plural kinds of stringed instruments, a chord supply device that supplies a chord, an indication device that indicates string stopping positions corresponding to the supplied chord supplied from the chord supply device with respect to the stringed instrument designated by the designation device, and a switching device that selectively sets a first mode in which a capotasto position can be set or a second mode in which the capotasto position cannot be set, wherein if the switching means sets the first mode in which the capotasto position can be set, the indication device changes the string stopping positions according to the set capotasto position and indicates string stopping positions changed from the string stopping positions, and if the switching device sets the second mode in which the capotasto position cannot be set, the indication devices indicates the string stopping positions directly without changing the string stopping positions.

Preferably, the chord indication apparatus according to the second aspect further comprises a display device that displays a picture representing a fingerboard and strings of the designated stringed instrument, and wherein if the switching device sets the first mode in which the capotasto position can be set, the indication device indicates a picture representing a capotasto on the displayed picture representing the fingerboard and strings correspondingly to the set capotasto position and indicates string stopping positions changed from the string plucking positions corresponding to the supplied chord according to the set capotasto position, and if the switching device sets the second mode in which the capotasto position cannot be set, the indication device indicates the string stopping positions corresponding to the supplied chord on the displayed picture representing the fingerboard and strings.

With the above arrangement of the chord indication apparatus according to the second aspect, a suitable chord can be indicated with respect to a stringed instrument for which a capotasto is not used frequently.

To attain the above object, according to a third object of the present invention, there is provided a chord indication apparatus which indicates string stopping positions for playing chords with a stringed instrument, the apparatus comprising a chord supply device that supplies a chord, an indication device that indicates, in a predetermined area, string stopping positions corresponding to the chord supplied from the chord supply device with respect to the stringed instrument, a pointing device that points the predetermined area, and a sounding device that sounds musical tones of the chord to which the string stopping positions indicated in the designated area by the indication device correspond.

Preferably, the chord indication apparatus according to the third aspect further comprises a designation device that designates a stringed instrument, for which the string stopping positions should be indicated, among plural kinds of stringed instruments, and the sounding device sounds the musical tones of the chord in a timbre of the designated stringed instrument.

Also preferably, the chord indication apparatus according to the third aspect further comprises a display device that displays a picture representing a fingerboard and strings of the designated stringed instrument, and wherein the predetermined area is an area in which the picture representing the fingerboard and strings is displayed.

With the above arrangement of the chord indication apparatus according to the third aspect, the indicated chord can be played for trial by simple operation.

To attain the above object, according to a fourth aspect of the present invention, there is provided a chord indication apparatus which indicates string stopping positions for playing chords with plural kinds of stringed instruments, the apparatus comprising a designation device that designates a stringed instrument, for which the string stopping positions should be indicated, among the plural kinds of stringed instruments, a chord supply device that supplies a chord, an indication device that indicates string stopping positions corresponding to the chord supplied from the chord supplied from the chord supply device with respect to the stringed instrument designated by the designation device;, and a sounding device that sounds the chord to which the string stopping positions indicated by the indication device correspond, in a timbre of the designated stringed instrument.

Preferably, the chord indication apparatus according to the fourth aspect further comprises a display device that displays a picture representing a fingerboard and strings of the designated stringed instrument, and wherein the indication device indicates string stopping positions corresponding to the supplied chord on the picture representing the fingerboard and strings.

With the above arrangement of the chord indication apparatus according to the fourth aspect, the sounds peculiar to the stringed instruments can be found when the chords are played for trial.

To attain the above object, according to a fifth aspect of the invention, there is provided a chord indication method of indicating string stopping positions for playing chords with plural kinds of stringed instruments, the method comprising the steps of storing, in a storage device, table data in which string stopping positions are indicated for a variety of chords with respect to the plural kinds of stringed instruments, designating a stringed instrument, for which the string stopping positions should be indicated, among the plural kinds of stringed instruments, supplying a chord, and retrieving table data corresponding to the designated stringed instrument from plural kinds of table data stored in the storage device and acquiring string stopping positions corresponding to the supplied chord from the retrieved table data.

To attain the above object, according to a sixth aspect of the present invention, there is provided a chord indication method of indicating string stopping positions for playing chords with plural kinds of stringed instruments, the method comprising the steps of designating a stringed instrument, for which the string stopping positions should be indicated, among the plural kinds of stringed instruments, supplying a chord, indicating string stopping positions corresponding to the supplied chord with respect to the designated stringed instrument, and selectively setting a first mode in which a capotasto position can be set or a second mode in which the capotasto position cannot be set, wherein if the first mode in which the capotasto position can be set is set, the string stopping positions are changed according to the set capotasto position and string stopping positions changed from the string stopping positions are indicated, and if the second mode in which the capotasto position cannot be set is set, the string stopping positions are indicated directly without changing the string stopping positions.

To attain the above object, according to a seventh aspect of the present invention, there is provided a chord indication method of indicating string stopping positions for playing chords with a stringed instrument, the method comprising the steps of supplying a chord, indicating, in a predetermined area, the string plucking positions corresponding to the supplied chord with respect to the stringed instrument, pointing the predetermined area, and sounding musical tones of the chord to which the string stopping positions indicated in the designated area correspond.

To attain the above object, according to an eighth aspect of the present invention, there is provided a chord indication method of indicating string stopping positions for playing chords with plural kinds of stringed instruments, the method comprising the steps of designating a stringed instrument, for which the string stopping positions should be indicated, among the plural kinds of stringed instruments, supplying a chord, indicating string stopping positions corresponding to the supplied chord with respect to the designated stringed instrument, and sounding the chord to which the indicated string stopping positions correspond, in a timbre of the designated stringed instrument.

To attain the above object, according to a ninth aspect of the present invention, there is provided a mechanically-readable storage medium which stores commands to instruct an apparatus to execute one of the chord indication methods according to the fifth to eighth aspects.

The above and other object, features, and advantages of the invention will become more apparent from the following detailed description taken in conjunction with the accompanying drawings.

BRIEF DESCRIPTION OF THE DRAWINGS

FIG. 10 is a flow chart showing a further portion of the main routine continued from FIG. 9;

DETAILED DESCRIPTION OF THE PREFERRED EMBODIMENT

The present invention will be described in further detail by way of example with reference to the accompanying drawings showing a preferred embodiment thereof.

Figure 1:
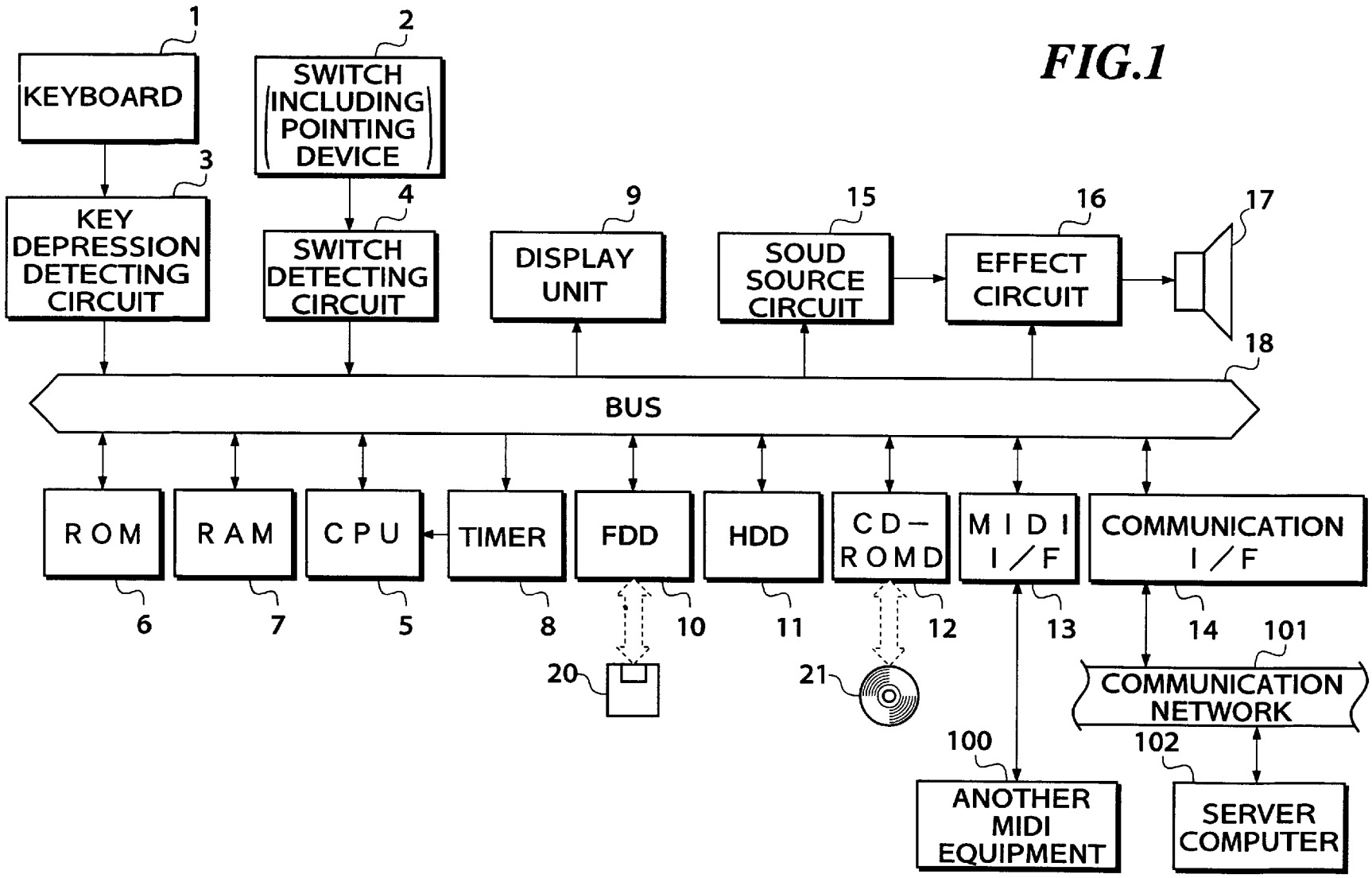
FIG. 1 is a block diagram schematically showing the structure of a chord indication apparatus according to an embodiment of the present invention.

FIG. 1 schematically shows the structure of a chord indication apparatus according to an embodiment of the present invention.

Figure 3:
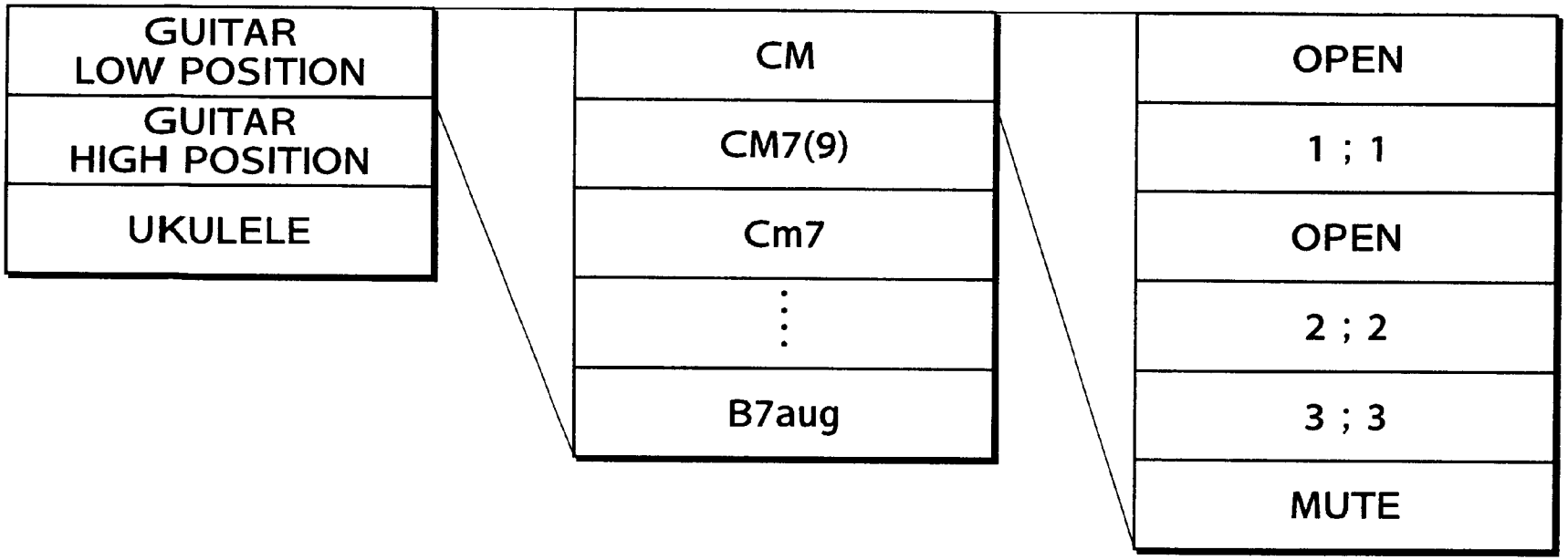
FIG. 3 is a view showing an example of a format of chord playing tables showing chords and string stopping positions therefor.

As shown in FIG. 1, the chord indication apparatus of this embodiment is comprised of a keyboard 1 for inputting information about pitch; a switch group 2 composed of a plurality of switches including a pointing device for controlling an indicating position of a pointing cursor C (see FIG. 4) for inputting various pieces of information, a key depression detecting circuit 3 for detecting the depressed state of each key of the keyboard 1, a switch detecting circuit for detecting the depressed state of each switch in the switch group 2, a CPU 5 for controlling the entire apparatus, a ROM 6 that stores control programs executed by the CPU 5 and a variety of table data and the like including a chord playing table in FIG. 3, a RAM 7 for temporarily containing performance data, various kinds of information, results of operations, and the like, a timer 8 for measuring a timer interrupting time in a timer interruption process and other times, a display unit 9 provided with, e.g. a large-sized liquid crystal display (LCD) or a cathode ray tube (CRT) display and light emitting diodes (LEDs) and the like for displaying various kinds of information, a floppy disk drive (FDD) 10 for driving a floppy disk (FD) 20 as a storage medium, a hard disk drive (HDD) 11 for driving a hard disk (not illustrated) on which a variety of application programs including the control programs, a variety of data, and the like can be stored, a CD-ROM drive (CD-ROMD) 12 for driving a compact disk read only memory (CD-ROM) on which a variety of application programs including the control programs, a variety of data, and the like can be stored, an MIDI interface (I/F) for receiving musical instrument digital interface (MIDI) signals from the outside and outputting the MIDI signals to the outside, a communication interface (I/F) 14 for transmitting data to and from, e.g., a server computer 102 on a communication network, a sound source circuit for converting performance data inputted from the keyboard 1 and predetermined performance data into musical sound signals, an effect circuit 16 for adding a variety of effects to the musical sound signals transmitted from the sound source circuit 15, and a sound system 17 composed of a digital-to-analog converter (DAC), an amplifier and a speaker for converting the musical sound signals from the effect circuit 16 into sounds.

The above-mentioned components 3–16 are interconnected through a bus 18. The timer 8 is connected to the CPU 5, another MIDI equipment 100 is connected to the MIDI I/F 13, the communication network 1001 is connected to the communication I/F 14, the effect circuit 16 is connected to the sound source circuit 15, and the sound system 17 is connected to the effect circuit 16.

As stated above, the control programs executed by the CPU 5 can be stored on the hard disk of the HDD 11. If the control programs are not stored in the ROM 6, the control programs are stored on the hard disk and are read into the RAM 7 so that the CPU 5 can operate in the same manner as in the case where the control programs are stored in the ROM 6. This facilitates the addition of control programs and the expansion in the functions.

The control programs and the variety of data are read from the CD-ROM 21 of the CD-ROM drive 12 and are stored on the hard disk of the HDD 11. This facilitates the installment of additional control programs and the expansion in the functions. An outside storage device other than the CD-ROM drive 12 may be provided in order to use various kinds of mediums such as a magneto optical disk.

The MIDI I/F 13 may be an all-purpose interface such as RS-232C, USB (universal serial bus) and IEEE 1394 (I triple E 1394). Then, the MIDI I/F 13 may transmit MIDI messages and other data simultaneously.

As stated above, the communication I/F 14 is connected to the communication network 101 such as a local area network (LAN), an Internet, and a telephone wire. The communication I/F 14 can connect to the server computer 102 on the communication network 101. If the programs and parameters are not stored on the hard disk of the HDD 11, the communication I/F 14 is used to download the programs and parameters from the server computer 102. A client computer (the chord indication apparatus in this embodiment) transmits a command to the server computer 102 on the communication network 101 to require the programs and the parameters. In response to the command, the server computer 102 transmits the required programs and parameters to the client computer. The client computer receives the programs and the parameters through the communication I/F 14 and stores them on the hard disk of the HDD 11 to complete the downloading.

The chord indication apparatus may also be provided with an interface for transmitting data directly to and from an outside computer or the like.

The chord indication apparatus of this embodiment indicates the chord for a six-stringed guitar and a four-stringed ukulele, and therefore it does not always require the keyboard 1 and the key depression detecting circuit 3. Thus, the components 1 and 3 may be omitted. As described above, the chord indication apparatus of this embodiment is constructed on the all-purpose personal computer, but the present invention should not be limited to this. The chord indication apparatus may also be constructed on a special apparatus that is composed of minimum components required for embodying the present invention.

Figure 2:
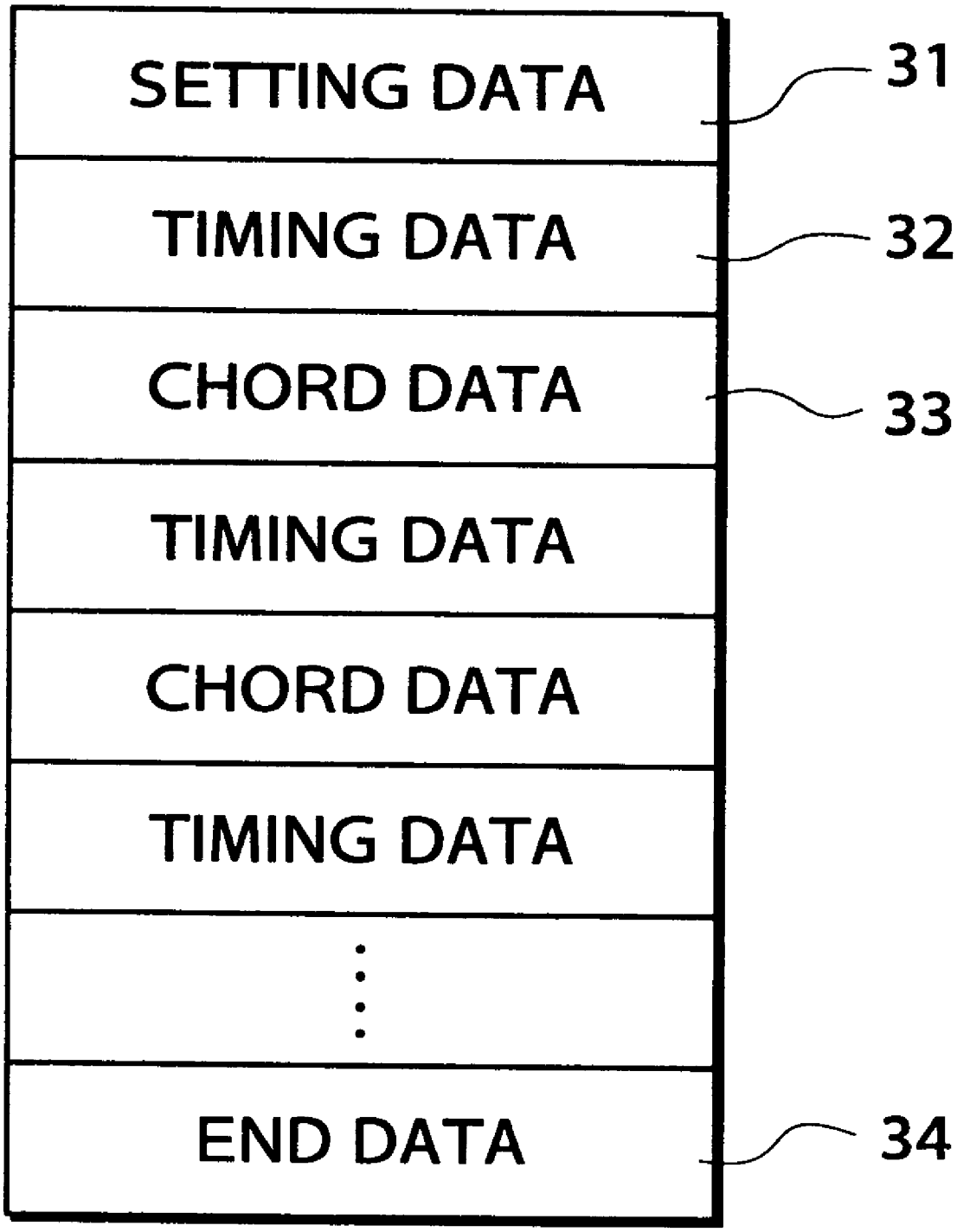
FIG. 2 is a view showing an example of a data format of music data.

FIG. 2 shows an example of a data format of music data regenerated by the chord indication apparatus of this embodiment.

As shown in FIG. 2, the music data is comprised mainly of setting data 31, timing data 32 indicating a timing for reading data located just after the setting data 31, chord data 33, and end data 34 indicating the end of the music data.

The setting data is composed of key data indicating a key of the music data, recommended capotasto position data (e.g., "1") indicating a recommended position where a capotasto is attached to the neck of the guitar, tempo data (e.g., "120") indicating a tempo of the music data, and others.

The timing data 21 indicates a relative time between the adjacent chord data 33, but the present invention should not be limited to this. It is also possible to adopt any other kind of timing data that represents a timing for reading the chord data 33, e.g., as an absolute time with respect to the entire music or measure. In this case, it is necessary to change timing data handling methods according to the types of adopted timing data. The timing data handling methods can be changed easily.

In this embodiment, the chord data 33 is composed of data indicating a chord root and data indicating a chord type. Chords (e.g., "B♭M7", "A" and "Dm") based on the key data in the setting data 31 are set in the chord data 33. These chords do not take the recommended capotasto position data in the setting data into consideration.

FIG. 3 shows an example of the format of chord playing tables indicating chords and string stopping positions therefor. In this embodiment, three kinds of tables for a low position of the guitar, a high position of the guitar and the ukulele are stored in the chord indication apparatus.

The tables are formed in the same format, and thus, FIG. 3 only shows the detailed format of the table for the low position of the guitar.

Each table shows the string stopping positions, i.e., which frets of the first to sixth strings are plucked by which fingers for playing the chords from "CM" to "B7aug." For example, "open", "1:1", "open", "2;2", "3;3" and "mute" are stated correspondingly to the first to sixth strings for the chord "CM" of the low position of the guitar. "1:1" means stopping the first fret with the first finger (the index finger). An integer at the left side of ";" indicates a fret number, and an integer at the right side of ";" indicates a finger number. The fingers from the index finger to the little finger are respectively denoted by integers "1"–"4". No finger number is designated for "open" and "mute."

The ukulele ordinarily has four strings, and thus, "mute" is designated for the fifth and sixth strings in the table relating to the ukulele. Thus, the four string plucking positions are practically designated.

The control process executed by the chord indication apparatus, which is constructed in the abovementioned manner, will be outlined first with reference to FIGS. 4–7, and then will be described in further detail with reference to FIGS. 8–12.

The chord indication apparatus of this embodiment executes the process as described below:

1) When the user clicks a music selection icon 9*a* to select one music data in the format in FIG. 2 and clicks a start/stop icon 9*b* to regenerate the music data, the data included in the music data are read sequentially. When the chord data 33 is read, the name of the chord as well as the circled finger numbers are displayed on a displayed fingerboard of the stringed instrument to thereby indicate the string stopping positions suitable for the chord. The user may click a guitar/ukulele icon 9*c* to select the guitar or the ukulele. When the user selects the guitar, he or she may click a high/low position icon 9*d* in order to select a high or low position. If the low position of the guitar is selected, the capotasto may be set.

2) When the user clicks the pointing cursor C at a certain position in the fingerboard which ia displayed with the string stopping positions while the regeneration of the music data is stopped, a chord corresponding to the displayed chord name is sounded in a timbre or tone color of the currently-selected stringed instrument (an audition function).

3) When the user clicks a code book icon 9*e*, a code book window W is opened. One of plural chord roots and one of plural code types displayed on the code book window W may be designated to select one chord. Then, the string stopping positions corresponding to the chord name and the selected stringed instrument are displayed regardless of the music data. In this case, the chord is sounded in a timbre of the currently-selected stringed instrument as is the case with (2).

Figure 4:
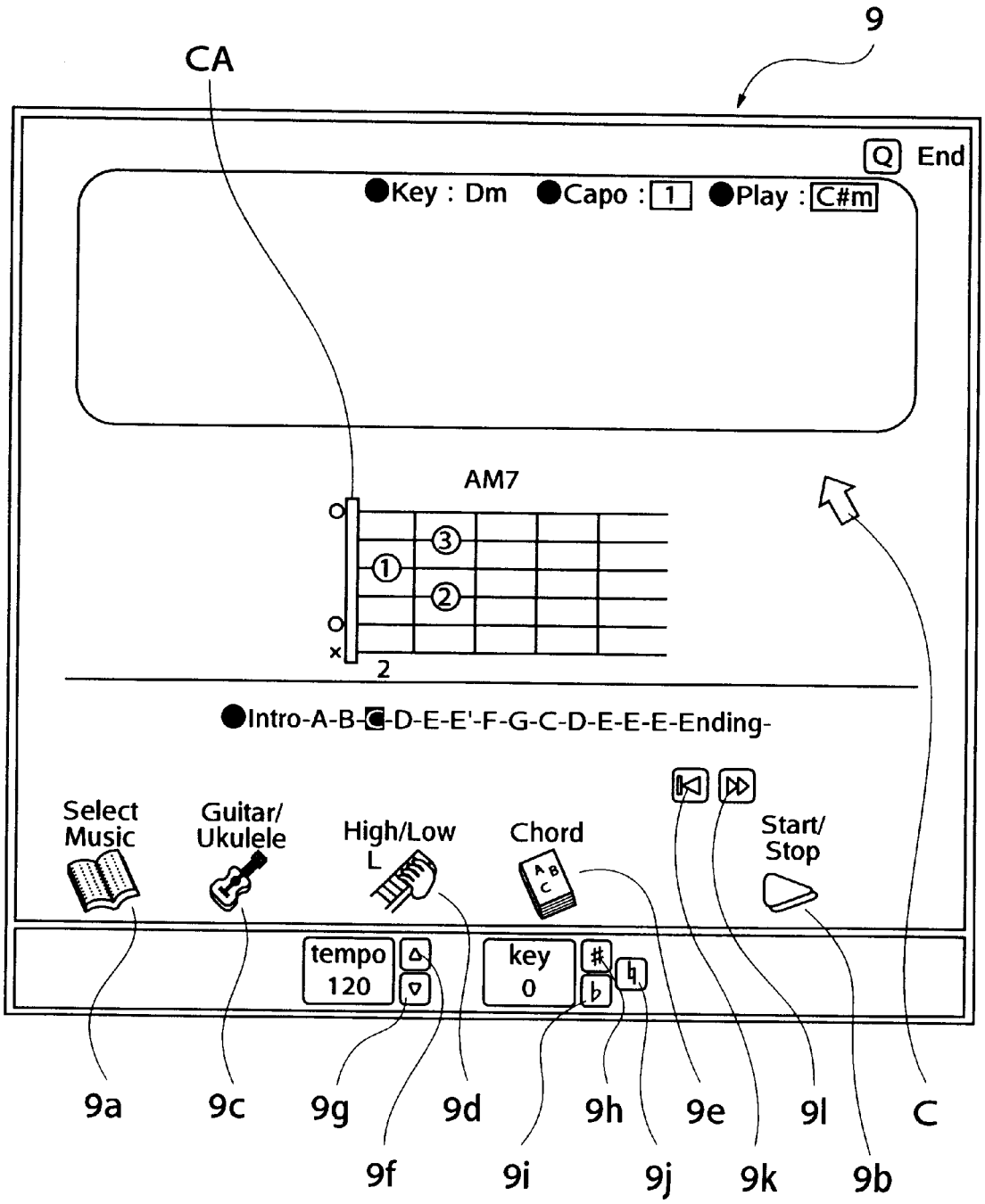
FIG. 4 is a view showing an example of a picture displayed on a display unit in FIG. 1 when a guitar is selected as a stringed instrument.

FIG. 4 shows an example of the display on the display unit 9 when the guitar is selected as the stringed instrument.

In FIG. 4, the start/stop icon 9*b* is displayed in the shape of ">>" to indicate the start, and thus, the illustrated display indicates that the regeneration of the music data is stopped like (2). The low position of the guitar is selected. "Dm" and "1" are selected as the key and the capotasto position, respectively, and thus a play key is "C#m". In this state, a chord "Bb M7" is displayed as "AM7" as shown in FIG. 4. The string stopping positions are displayed on a fingerboard including four frets from the capotasto position CA toward a bridge (not illustrated) as shown in FIG. 4. The string stopping positions are indicated by circled finger numbers on the fingerboard. "Capo:1" is displayed, and thus the capotasto position CA lies in the first fret toward the bridge from a nut (not illustrated). The fingerboard from the capotasto position CA toward a neck (not illustrated) is not displayed in order to effectively use a display area. An integer ("2") displayed below the fingerboard indicates a fret number, "○" at the left side of the capotasto position CA indicates an open string, and "×" indicates a mute string.

The chord indication apparatus of this embodiment displays a currently-set tempo ("120"), which can be increased or decreased by clicking an up button ("Δ") 9*f* or a down button ("▽") 9*g*. The play key can be heightened or lowered by a half tone every time a sharp tone button ("#") or a flat tone button ("♭") is clicked, and the play key can be returned to the original key by clicking a natural button 9*j*.

A button 9*k* for returning to the lead of the music data and a fast-forwarding button 91 are also provided, and a mark indicating a passage is also displayed.

Figure 5:
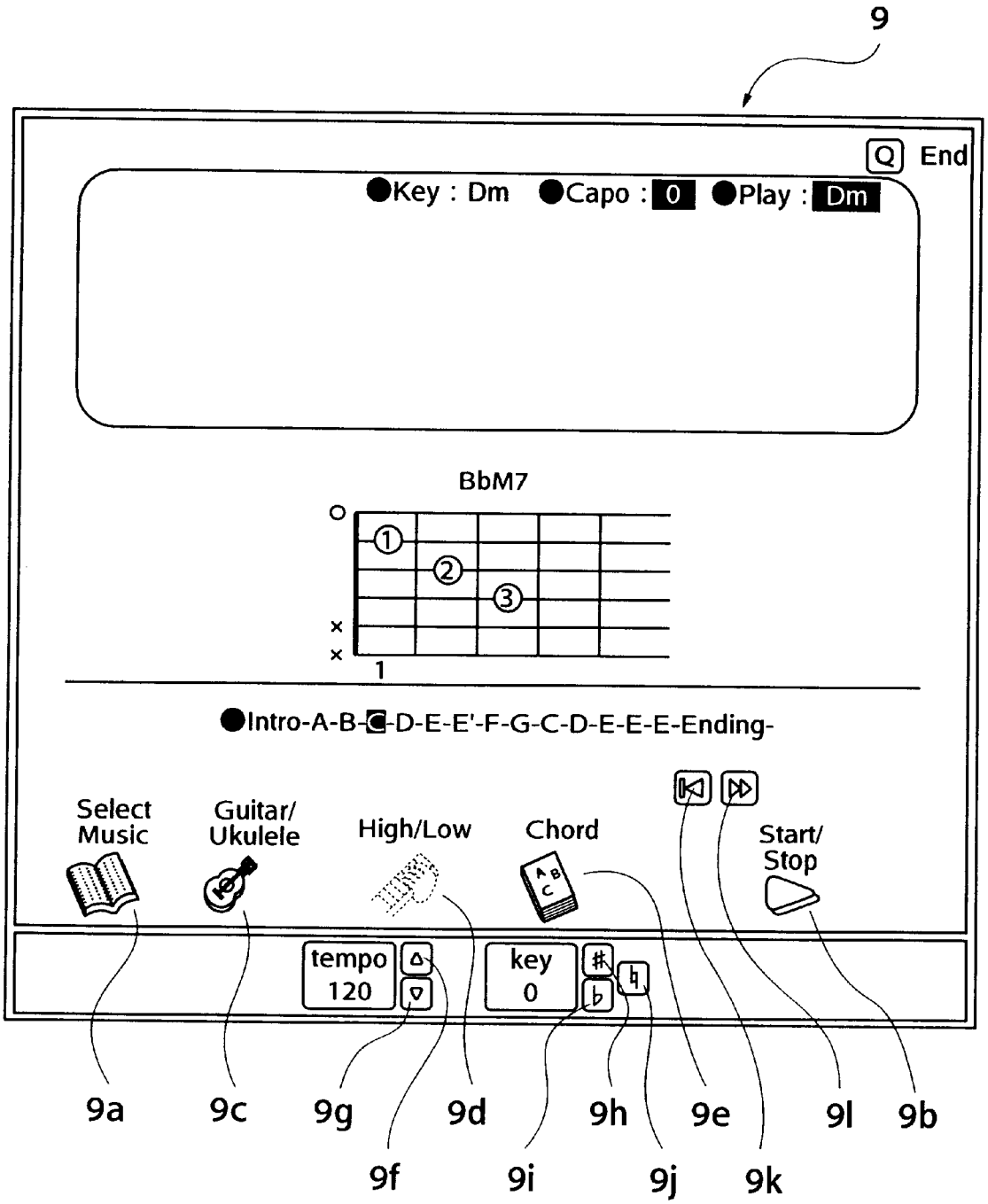
FIG. 5 is a view showing an example of a picture displayed on a display unit in FIG. 1 when a ukulele is selected as a stringed instrument.

FIG. 5 shows an example of the display on the display unit 9 when the ukulele is selected as the stringed instrument.

The distinction between the ukulele and the guitar is that, if the ukulele is selected, the high position and the low position cannot be switched to one another and the capotasto position cannot be set. For this reason, the high/low position icon 9*d* is displayed as a gray scale so as not to be clicked. The capotasto position is inverted to indicate that the capotasto position cannot be set and "Capo:0" is displayed. The play key is the same as the key. The shape of the guitar/ukulele icon 9*c* changed from the guitar to the ukulele.

Figure 6:
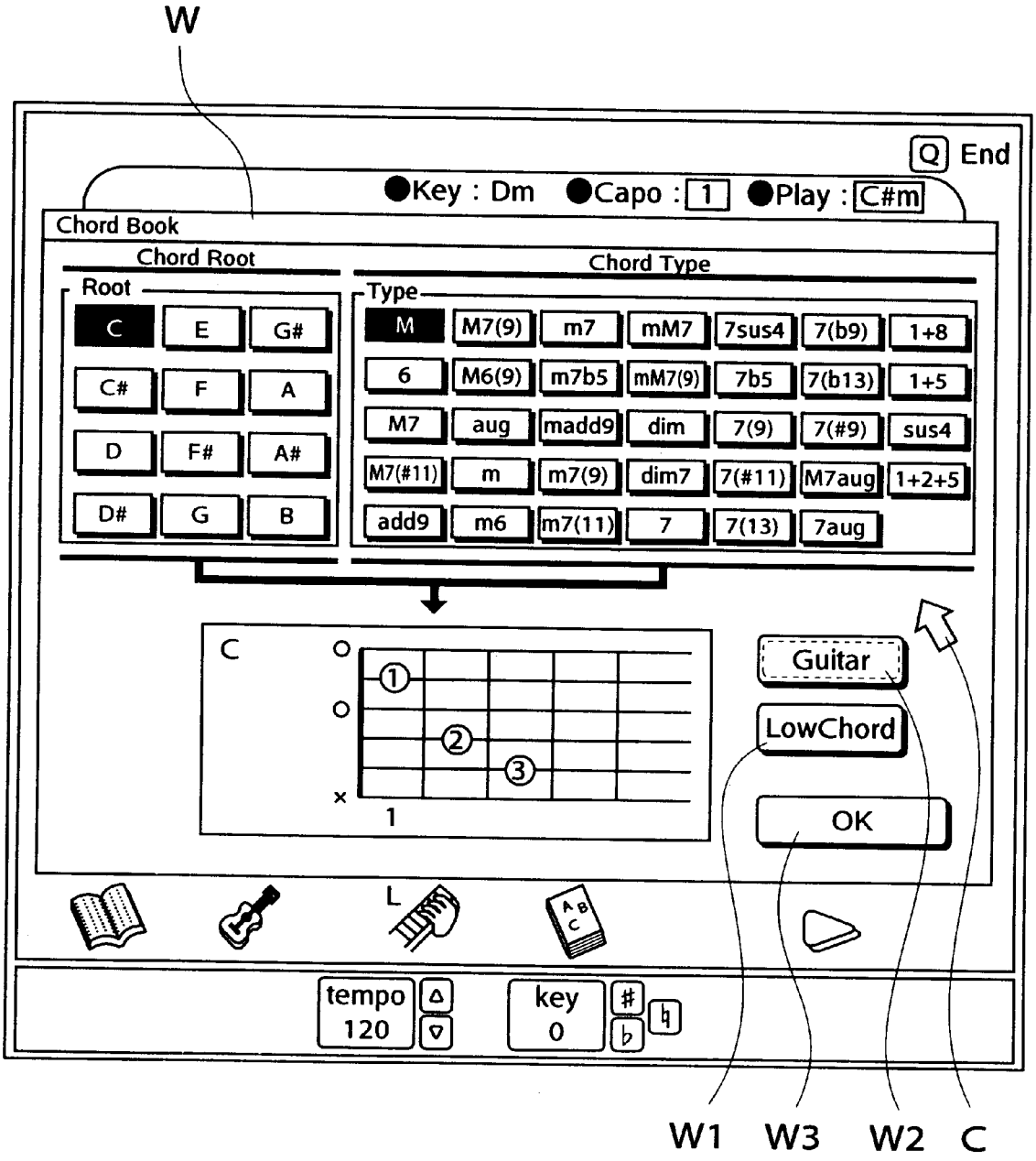
FIG. 6 is a view showing an example of a code book window displayed on a display unit in FIG. 1 when a guitar is selected as a stringed instrument.

FIG. 6 shows an example of the code book window W displayed on the display unit 9 when the guitar is selected as the stringed instrument.

In FIG. 6, the string plucking positions are indicated for a chord "CM" in the state wherein the guitar ("Guitar") and the low chord ("LowChord") are selected.

If a low chord button ("LowChord") W1 is clicked in the state of FIG. 6, the low chord button W1 is changed to a high chord button (not illustrated) and the string stopping positions for the high chord are displayed.

Figure 7:
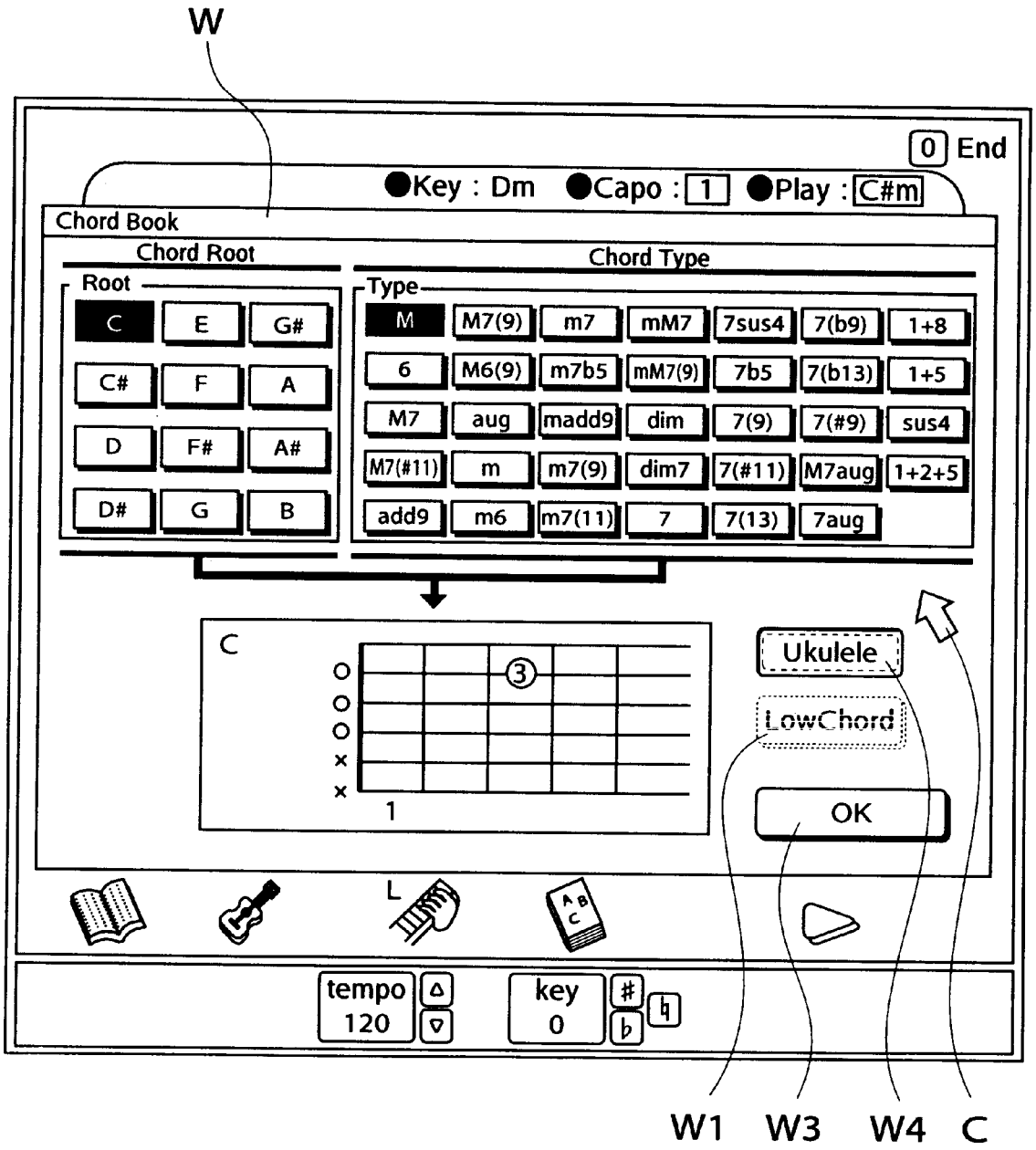
FIG. 7 is a view showing an example of a code book window displayed on a display unit in FIG. 1 when a ukulele is selected as a stringed instrument.

If a guitar button ("Guitar") W2 is clicked in the state of FIG. 6, the same code book window W displayed in the case where the ukulele ("Ukulele") is selected is displayed as shown in FIG. 7. If the ukulele is selected, the high position and the low position cannot be selected as stated above. For this reason, the low chord button W1 is displayed as a gray scale so as not to be clicked.

In FIGS. 6 and 7, a chord corresponding to the displayed chord name is sounded in a timbre of a currently-selected stringed instrument if the chord root or type is selected or if the low/high chord and the guitar/ukulele are selected.

A detailed description will now be given of the control process.

FIGS. 8–11 are flow charts showing the main routine executed by the chord indication apparatus of this embodiment, and more particularly by the CPU 5.

Figure 8:
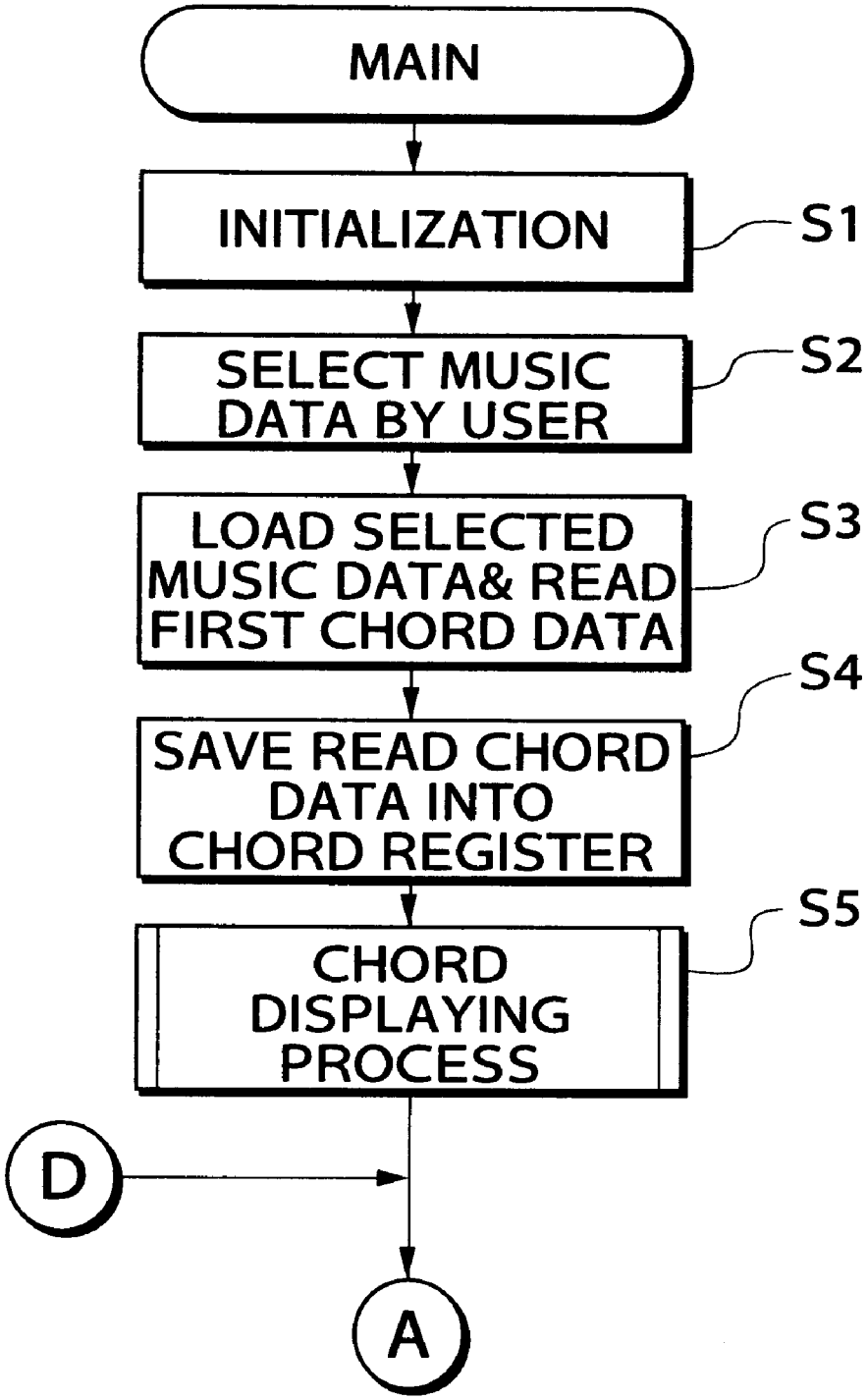
FIG. 8 is a flow chart showing a main routine executed by the chord indication apparatus in FIG. 1, particularly by a CPU.

In FIG. 8, the initialization is performed first (step S1). For example, the guitar is selected as the stringed instrument, and the display of the string stopping positions for the chord is set to the low position.

Next, a display (not illustrated) instructs the user to select music data. If the user selects the music data by clicking the music selection icon 9*a* (step S2), the selected music data is loaded in a music data region in the RAM 7 and the first chord data is read (step S3). The read chord data is stored in a chord register of the RAM 7 (step S4).

Then, the CPU 5 executes a subroutine for displaying the chord as described below (step S5).

Figure 12:
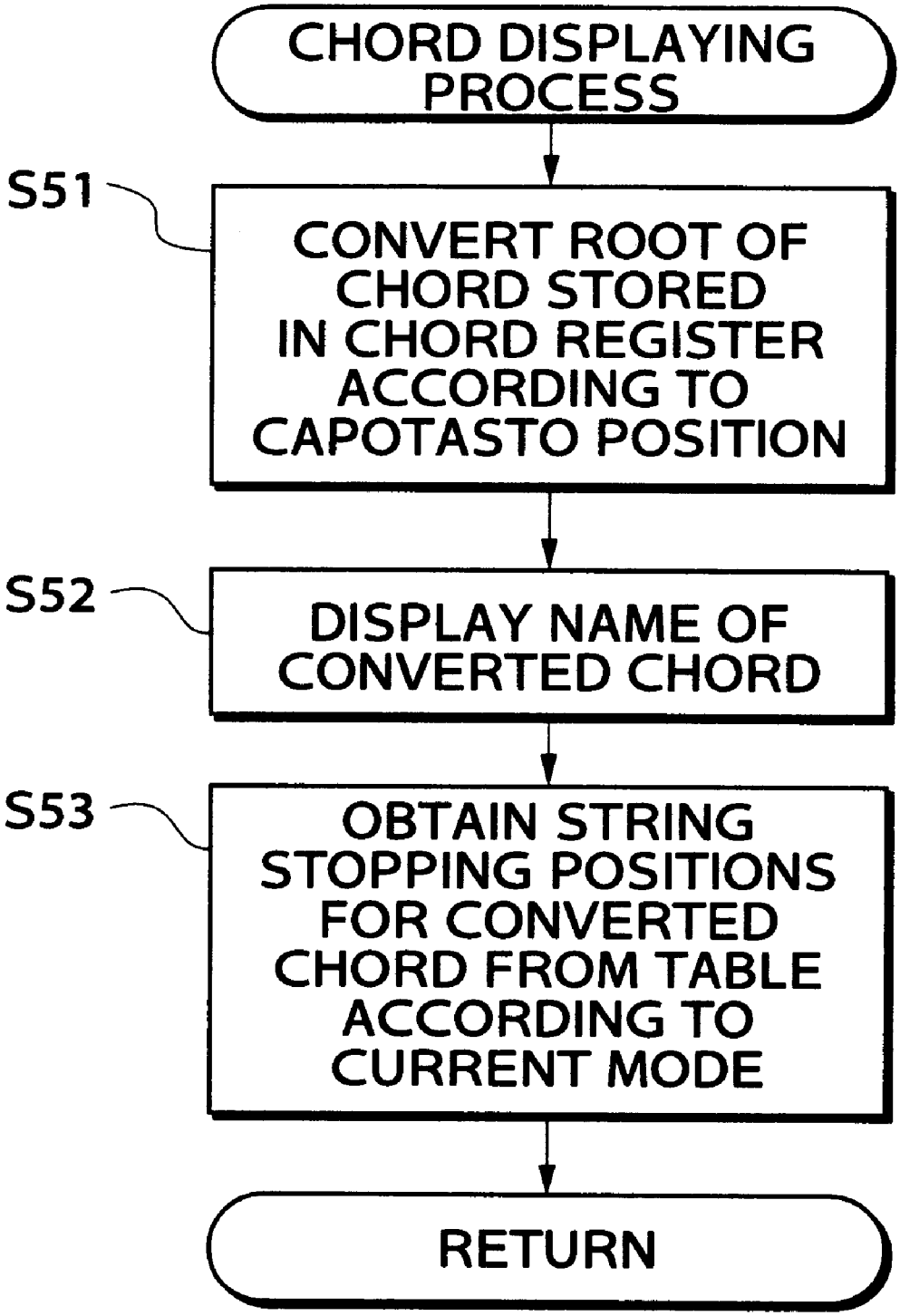
FIG. 12 is a flow chart showing details of a subroutine for indicating a chord in FIG. 8 for example.

FIG. 12 is a flow chart showing the subroutine for displaying the chord, In FIG. 12, the code root stored in the chord register is converted according to the set capotasto position (step S51).

Then, the name of the chord after the conversion of the code root is displayed on a fingerboard as shown in FIG. 4 or 5 (step S52).

Then, the string stopping positions after the conversion are found with reference to a table (one of the three tables described with reference to FIG. 3) corresponding to one of the following three display modes: the low position of the guitar, the high position of the guitar and the ukulele. The string stopping positions are displayed on the fingerboard as shown in FIG. 4 or 5 (step S53), and the subroutine for displaying the chord is terminated.

Figure 9:
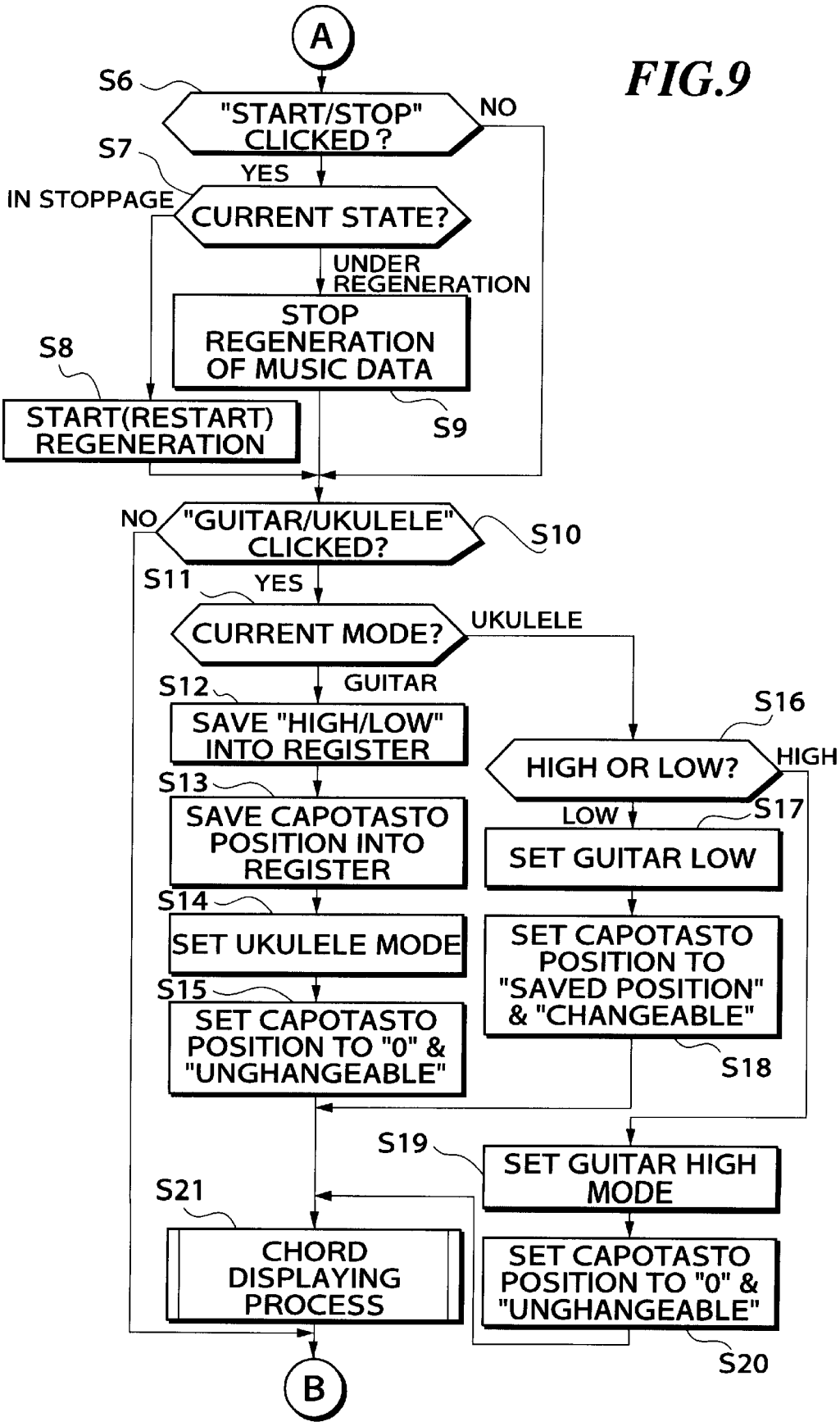
FIG. 9 is a flow chart showing another portion of the main routine continued from FIG. 8.

Then, the process goes back to the main routine, and whether the user clicked the start/stop icon 9*b* or not is determined (step S6 in FIG. 9). If the user clicked the start/stop icon 9*b*, the regeneration state of the current music data is checked (step S7). If the music data is stopped, the regeneration of the music data is started (or restarted) and the shape of the start/stop icon 9*b* is changed from ">>" to "□" (step S8). On the other hand, if the music data is being regenerated, the regeneration of the music data is suspended and the shape of the start/stop icon 9*b* is changed from "□" to ">>".

On the other hand, if the user did not click the start/stop icon 9*b* at the step S6, the steps S7–S9 are skipped and the process goes to a step S10.

At the step S10, whether the user clicked the guitar/ukulele icon 9*c* or not is determined. If the user clicked the guitar/ukulele icon 9*c*, the current display mode is checked (step S11).

If the current display mode is determined as the "guitar mode" at the step S11, the process goes to a step S12 to execute the process at steps S12–S15. If the current display mode is determined as the "ukulele mode" at the step S11, the process goes to a step S16. The step S16 branches into two, and a process at steps S17 and S18 or a process at steps S19 and S20 is executed according to the saved position state.

At the steps S12 and S13, the current position state (the high position or the low position) and the set capotasto position are saved in the register. At the step S14, the display mode is set as the "ukulele mode", and at the step S15, the capotasto position is set to "0" and "impossible to change" (the capotasto position and the play key are inverted on the display).

Whether the position state saved at the step S12 is the low position or the high position is determined at the step S16. In the case of the low position, the display mode is set as a "guitar low position mode" at the step S17, and the capotasto position is set to the "capotasto position saved at the step S13" and "possible to change" at the step S18. In the case of the high position, the display mode is set as a "guitar high position mode" at the step S19, and the capotasto position is set to "0" and "impossible to change" at the step S20 as is the case with the step S15.

At a step S21, the subroutine for displaying the chord is executed as is the case with the step S5, and the process goes to a step S22 in FIG. 10.

At the step S22, whether the user clicked the code book icon 9*e* or not is determined. If the user clicked the code book icon 9*e*, the code book window W is opened (step S23). Here, it is assumed that as the initial state, "C" and "M (Major)" are selected (inverted) as the chord root and the chord type, respectively.

Whether the user clicked any one among many "chord roots" and many "chord types" displayed in the code book window W is determined (step S24). If the user clicked any chord root or chord type, the clicked chord root or chord type is selected (inverted). A chord is determined based on a combination of the selected chord root and chord type (the chord roots and the chord types which are not selected this time were selected in the above-mentioned initial state or the previous clicking) (step S25). The string stopping positions for the determined chord are found with reference to the table corresponding to the current display mode and displayed, and the chord is sounded in a timbre corresponding to the current display mode (the guitar or the ukulele) (step S26).

At a step S27, whether the user clicked an OK button W3 in FIG. 6 or 7 is determined. If the user did not click the OK button W3, the process goes back to the step S24 to repeat the above processing. If the user clicked the OK button W3, the process goes to a step S28 to close the chord book window W.

On the other hand, if the user clicked neither the "chord root" nor the "chord type", the process goes to a step S29 to determine whether the user clicked the guitar button ("Guitar") W2 or not.

If the user clicked the guitar button W2, the guitar button W2 is changed to a ukulele button ("Ukulele") W4. Then, the display mode is set as the "ukulele mode" (step S30), and the process goes to the step S26.

At the steps S29 and S30 in FIG. 10, a process executed in the case where the user clicks the ukulele button ("Ukulele") W4 is indicated by replacing the words "Guitar" and "Ukulele" with the words "Ukulele" and "Guitar" in parentheses, respectively.

If it is determined at the step S29 that the user did not click the guitar button W2, whether the user clicked the low chord button ("LowChord") W1 or not is determined (step S31).

If it is determined at the step S31 that the user clicked the low chord button W1, the low chord button W1 is changed to a high chord button (not illustrated). Then, the display mode is set as the "guitar high position mode" (step S32), and the process goes to the step S26. If the display mode is the ukulele mode, however, the low chord button W1 cannot be clicked. In this case, it is determined at the step S31 that the user did not click the low chord button W1 even if the low chord button W1 is clicked.

At the steps S31 and S32 in FIG. 10, a process executed in the case where the user clicks the high chord button is indicated by replacing the words "LowChord" and "HighChord" with the words "HighChord" and "LowChord" in parentheses, respectively.

On the other hand, if it is determined at the step S31 that the user did not click the low chord button W1, the process goes to the step S27.

Figure 11:
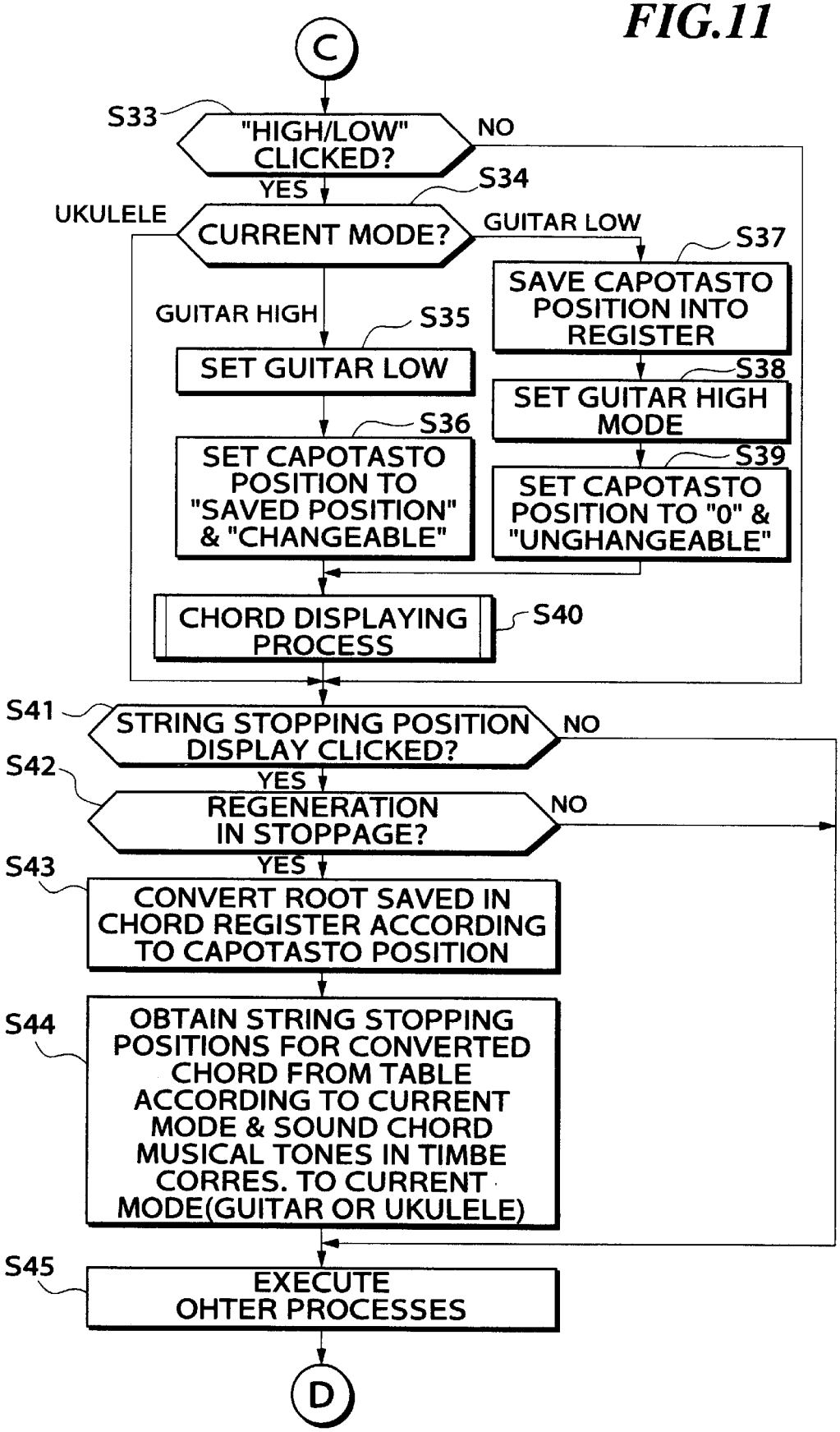
FIG. 11 is a flow chart showing a still further portion of the main routine continued from FIG. 10.

Whether the user clicked the high/low position icon 9*d* or not is determined at the next step S33 in FIG. 11. If it is determined that the user clicked the high/low position icon 9*d*, the current display mode is checked (step S34).

If the current display mode is the guitar high position mode, the same process at the steps S17 and S18 is executed at steps S35 and S36. Then, the subroutine for displaying the chord is executed as is the case with the step S5 (step S40).

On the other hand, if the current display mode is the guitar low position mode, the same process at the steps S12–S15 is executed at steps S37–S39, and then the subroutine for displaying the chord is executed as is the case with the step S5 (step 40). If the current display mode is the ukulele mode, the process goes directly to a step S41.

On the other hand, if it is determined at the step S33 that the user did not click the high/low position icon 9*d*, the steps S34–40 are skipped and the process goes to the step S41.

Whether the user clicked the fingerboard or not is determined at the step S41. If the user clicked the fingerboard, whether the music data is now being regenerated or not is determined (S42).

If it is determined at the step S42 that the music data is not being regenerated, the chord root of the chord stored in the chord register is converted according to the set capotasto position (step S43) as is the case with the step S51 in the subroutine for displaying the chord. Then, the string plucking positions for the determined chord are found with reference to the table corresponding to the current display mode, and the chord is sounded in a timbre (the guitar or the ukulele) corresponding to the current display mode (step S44).

Other processes are executed at the next step S45, and the process goes back to the step S6 to repeat the above described processing. Examples of the other processes are given below:

1) When the user clicks the button 9*k* for returning to the lead of the music data, the regeneration position of the music data is returned to the lead.

2) When the user clicks the fast-forwarding button 9*l*, the regeneration position of the music data is advanced (more specifically, a single click advances the music data by one measure, and continuously pressing the fast-forwarding button continuously advances the music data at a high speed during the pressing. If the fast-forwarding button 91 is clicked while the regeneration of the music data is stopped, the music data stops at the advanced position. If the fast-forwarding button 91 is clicked during the regeneration of the music data, the regeneration is started from the advanced position).

3) If "Capo:" is clicked in the guitar low position mode, the up/down button is displayed near "Capo:" and is clicked to make it possible to change the capotasto position (the capotasto position can be changed, for example, within a range between 0 and 11. If the capotasto position is changed, the play key is changed, too. For example, the capotasto position and the play key are changed from "Capo:1", "Play:C#m" to "Capo:2" and "Play:Cm", respectively. In the case of the guitar high position mode or the ukulele mode, however, nothing is changed even if "Capo:" is clicked.)

4) The tempo and the key are changed, and others.

Figure 13:
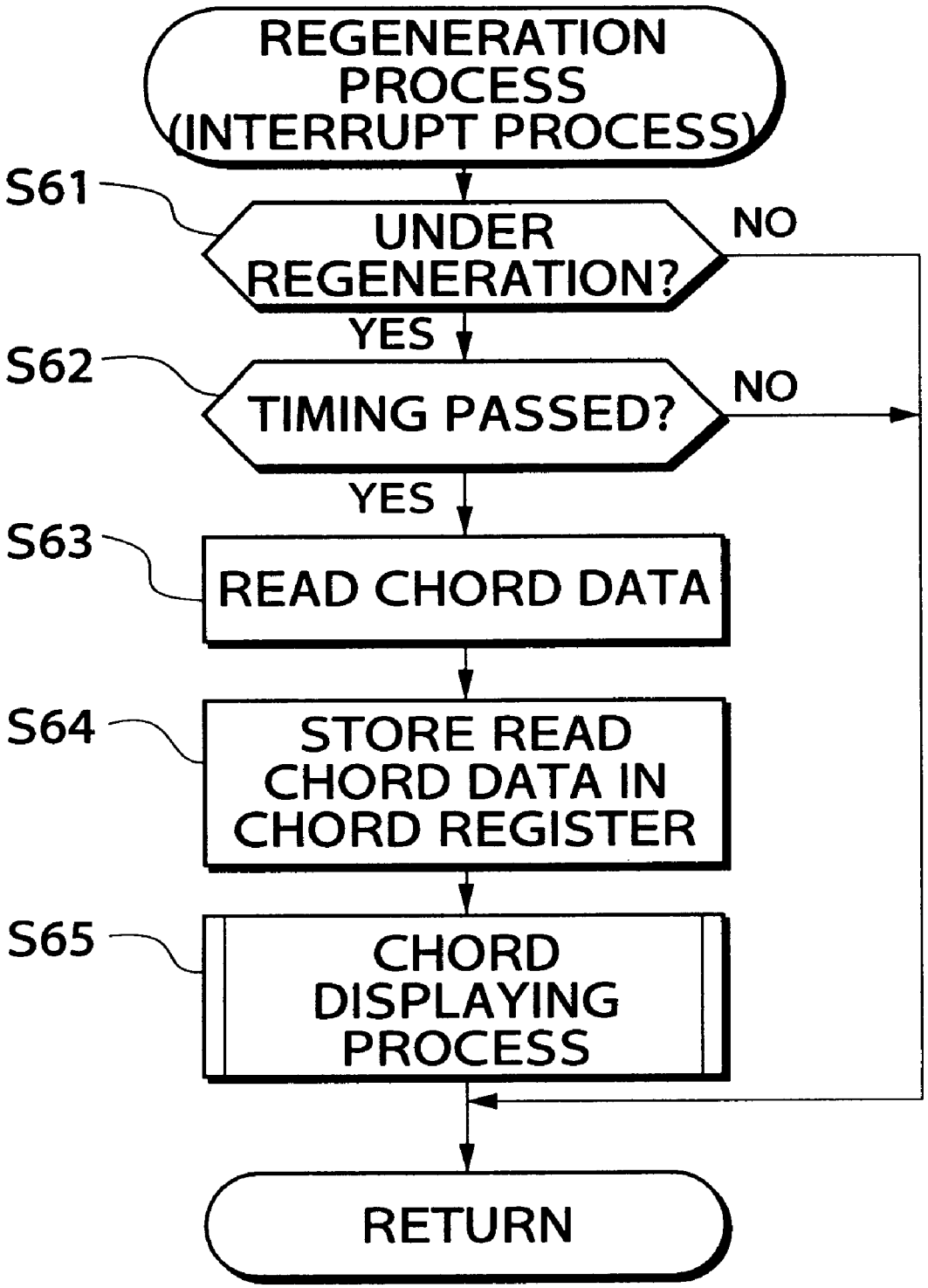
FIG. 13 is a flow chart showing a regeneration process.

FIG. 13 is a flow chart showing a regeneration process, which is an interruption process executed at time intervals corresponding to the tempo.

As shown in FIG. 13, whether the current music data is now being regenerated or not is determined first (step S61). If the current music data is now being regenerated, whether the time indicated by the read timing data has passed or not is determined by, for example, storing the read timing data in a software timer area, decrementing the timing data at regular time intervals and checking the time when the timing data becomes 0 (step S62).

If it is determined at the step S62 that the time indicated by the read timing data has already passed, the chord data positioned next to the timing data is read from the music data (step S63). The read chord data is stored in the chord register as is the case with the step S4 (step S64). Then, the subroutine for displaying the chord is executed as is the case with the step S5 (step S65), and the regeneration process is terminated.

On the other hand, the regeneration process is terminated immediately if it is determined at the step S61 that the current music data is stopped, or if it is determined at the step S62 that the time indicated by the read timing data has not passed yet.

In the regeneration, of course, the timing data is read and stored in the software timer area, the timing data stored in the software timer area is decremented, the regeneration is stopped when the end data 34 is read. These processes are omitted from the above explanation only for convenience's sake.

As described above, in this embodiment, the tables showing the string stopping positions are stored according to the types of the stringed instruments, i.e., the guitar low position, the guitar high position and the ukulele. Thus, the string stopping positions are indicated with respect to different kinds of stringed instruments so that the chords can be practiced effectively for those stringed instruments.

Moreover, it is possible to predetermine whether the capotasto position can be set or cannot be set according to the type of the stringed instrument for which the chord should be indicated. More specifically, the capotasto position can be set for the guitar low position, but the capotasto position cannot be set for the guitar high position and the ukulele. Therefore, a suitable chord can be indicated with respect to a stringed instrument for which a capotasto is not used frequently.

Furthermore, the musical tones of a chord are sounded by clicking a display area portion of the display unit in which the chord is displayed, specifically, the fingerboard with the pointing cursor, and thus, the indicated chord can be played for trial by simple operation. More specifically, the chord is displayed in a relatively wide area, and thus, the pointing device can be operated more roughly compared with the case where a small button only for sounding is provided and is clicked. Even if the button is large, the display area of the display unit cannot be used effectively since the button may only be used for the sounding. The chord indication apparatus of this embodiment can solve this problem.

In addition, the chord indication apparatus of this embodiment can sound the musical tones of the indicated chord in different timbres according to types of stringed instruments. Thus, the sounds peculiar to the stringed instruments can be found when the chords are played for trial.

In this embodiment, the guitar and the ukulele are given as examples of stringed instruments for convenience's sake, but this invention can also be applied to other kinds of stringed instruments; e.g., a combination of the guitar and a bass guitar, a combination of the bass guitar and the ukulele, a combination of the same kind of stringed instruments with different number of strings, and an arbitrary combination of these stringed instruments.

The timbre or tone color of the guitar is different according to kinds of stringed instruments such as an acoustic guitar and an electric guitar. A user may arbitrarily select a timbre when the chord is played for trial.

In this embodiment, the string stopping positions are displayed for only one chord at the currently regenerated position of the music data, but the string stopping positions may also be displayed for plural chords. For example, a next chord as well as the chord at the currently regenerated position may be displayed simultaneously, or the respective chords before and after the chord at the currently regenerated position may be displayed simultaneously.

In this embodiment, only the chord progressing data is supplied as the music data as shown in FIG. 2, but this invention should not be limited to this, and other kinds of data may be supplied. For example, a melody part, a bass part, a backing part, and the like may also be supplied as the music data so that the chord can be indicated during the performance of the melody part and the like. In this case, if the performance of the stringed instrument part can be muted, a user can play the stringed instrument more easily while looking at the displayed chord. Moreover, lyric data may also be supplied as the music data so that the lyrics can be supplied and displayed and the melody can be muted (or the sound of the music is turned down) with the progress of the music. In this case, the chord indication apparatus of the present invention may be used may be used as a sing-along or karaoke machine in which the stringed instrument part is played by the user.

In this embodiment, the music data includes the recommended capotasto positions, but this invention should not be limited to this. If the musical data includes no recommended capotasto positions, capotasto positions may be preset according to keys of music and the capotasto position may be automatically determined according to key data in the music data in order to facilitate a musical performance.

The object of this invention can also be achieved by providing a system or apparatus with a storage medium containing a software program code for realizing the functions of the above-described embodiment and reading the program code from the storage medium by a computer (or the CPU 5 and the MPU) of the system or apparatus for execution.

In this case, the program code read from the storage medium realizes the novel functions of this invention, and the storage medium containing the program code constitutes this invention.

Examples of the storage medium containing the program code are the floppy disk 20, a hard disk, an optical disk, a magneto optical disk, the CD-ROM 21, a CD-R, a non-volatile memory card and the ROM 6. Alternatively, the program code may be supplied from the server computer 102 through the MIDI equipment 100 and the communication network 101.

Of course, the functions of the above described embodiment can be realized not only by executing the program code read by means of the computer but also by executing a part or the whole of the actual processing by means of an operating system or the like working on the computer in accordance with commands of the program code.

Moreover, it goes without saying that the functions of the above-described embodiment can be realized by executing a part or the whole of the actual processing by means of the CPU 5 provided in a function expansion board inserted in the computer or a function expansion unit connected to the computer in accordance with commands of the program code after the program code read from the storage medium is stored in a memory provided in the function expansion board or the function expansion unit.

It should be understood, however, that there is no intention to limit the invention to the specific forms disclosed, but on the contrary, the invention is to cover all modifications, alternative constructions and equivalents falling within the spirit and scope of the invention as expressed in the appended claims.

What is claimed is:

1. A chord indication apparatus which indicates string stopping positions for playing chords with plural kinds of stringed instruments, said apparatus comprising:

a storage device that stores plural kinds of table data describing string stopping positions for a variety of chords with respect to said plural kinds of stringed instruments;

a designation device that designates a stringed instrument, for which said string stopping positions should be indicated, among said plural kinds of stringed instruments;

a chord supply device that supplies a chord; and an indication device that retrieves table data corresponding to the stringed instrument designated by said designation device from the plural kinds of table data stored in said storage device, obtains string stopping positions corresponding to the chord supplied from said chord supply device from said retrieved table data, and indicates the obtained string stopping positions.

2. A chord indication apparatus as defined in claim 1, further comprising a display device that displays a picture representing a fingerboard and strings of the designated stringed instrument, and wherein said indication device indicates string stopping positions for said supplied chord on said displayed picture representing the fingerboard and strings.

3. A chord indication apparatus which indicates string stopping positions for playing chords with plural kinds of stringed instruments, said apparatus comprising:

a designation device that designates a stringed instrument, for which said string stopping positions should be indicated, among said plural kinds of stringed instruments;

a chord supply device that supplies a chord;

an indication device that indicates string stopping positions corresponding to the supplied chord supplied from the chord supply device with respect to the stringed instrument designated by said designation device; and a switching device that selectively sets a first mode in which a capotasto position can be set or a second mode in which the capotasto position cannot be set;

wherein if said switching means sets said first mode in which said capotasto position can be set, said indication device changes said string stopping positions according to the set capotasto position and indicates string stopping positions changed from said string stopping positions, and if said switching device sets said second mode in which said capotasto position cannot be set, said indication devices indicates said string stopping positions directly without changing said string stopping positions.

4. A chord indication apparatus as defined in claim 3, further comprising a display device that displays a picture representing a fingerboard and strings of the designated stringed instrument, and wherein if said switching device sets said first mode in which said capotasto position can be set, and indication device indicates a picture representing a capotasto on said displayed picture representing the fingerboard and strings correspondingly to the set capotasto position and indicates string stopping positions changed from said string stopping positions corresponding to said supplied chord according to the set capotasto position, and if said switching devices sets said second mode in which said capotasto position cannot be set, said indication device indicates said string stopping positions corresponding said supplied chord on said displayed picture representing the fingerboard and strings.

5. A chord indication apparatus which indicates string stopping positions for playing chords with plural kinds of stringed instruments, said apparatus comprising:

a designation device that designates a stringed instrument, for which said string stopping positions should be indicated, among said plural kinds of stringed instruments;

a chord supply device that supplies a chord;

an indication device that indicates, in a predetermined area, string stopping positions corresponding to the chord supplied from said chord supply device with respect to the stringed instrument designated by said designation device by displaying said string stopping positions;

a pointing device that points said predetermined area; and a sounding device that sounds musical tones of said chord to which said string stopping positions indicated in said designated area by said indication device correspond.

6. A chord indication apparatus as defined in claim 5, wherein said sounding device sounds the musical tones of said chord in a timbre of the designated stringed instrument.

7. A chord indication apparatus as defined in claim 5, further comprising a display device that displays a picture representing a fingerboard and strings of the designated stringed instrument, and wherein said predetermined area is an area in which said picture representing the fingerboard and strings is displayed.

8. A chord indication apparatus which indicates string stopping positions for playing chords with plural kinds of stringed instruments, said apparatus comprising:

a designation device that designates a stringed instrument, for which said string stopping positions should be indicated, among said plural kinds of stringed instruments;

a chord supply device that supplies a chord;

an indication device that indicates string stopping positions corresponding to the chord supplied from said chord supplied from said chord supply device with respect to the stringed instrument designated by said designation device; and a sounding device that sounds said chord to which said string stopping positions indicated by said indication device correspond, in a timbre of the designated stringed instrument.

9. A chord indication apparatus as defined in claim 8, further comprising a display device that displays a picture representing a fingerboard and strings of the designated stringed instrument, and wherein said indication device indicates string stopping positions corresponding to said supplied chord on said picture representing the fingerboard and strings.

10. A chord indication method of indicating string stopping positions for playing chords with plural kinds of stringed instruments, said method comprising the steps of:

storing, in a storage device, table data in which string stopping positions are indicated for a variety of chords with respect to said plural kinds of stringed instruments;

designating a stringed instrument, for which the string stopping positions should be indicated, among said plural kinds of stringed instruments;

supplying a chord; and retrieving table data corresponding to the designated stringed instrument from plural kinds of table data stored in said storage device and acquiring string stopping positions corresponding to the supplied chord from the retrieved table data.

11. A chord indication method of indicating string stopping positions for playing chords with plural kinds of stringed instruments, said method comprising the steps of:

designating a stringed instrument, for which said string stopping positions should be indicated, among said plural kinds of stringed instruments;

supplying a chord;

indicating string stopping positions corresponding to the supplied chord with respect to the designated stringed instrument; and selectively setting a first mode in which a capotasto position can be set or a second mode in which the capotasto position cannot be set;

wherein if said first mode in which said capotasto position can be set is set, said string stopping positions are changed according to the set capotasto position and string stopping positions changed from said string stopping positions are indicated, and if said second mode in which said capotasto position cannot be set is set, said string stopping positions are indicated directly without changing said string stopping positions.

12. A chord indication method of indicating string stopping positions for playing chords with plural kinds of stringed instruments, said method comprising the steps of:

designating a stringed instrument, for which said string stopping positions should be indicated, among said plural kinds of stringed instruments;

supplying a chord;

indicating, in a predetermined area, the string stopping positions corresponding to the supplied chord with respect to the designated stringed instrument by displaying said string stopping positions;

pointing said predetermined area; and sounding musical tones of said chord to which said string stopping positions indicated in the designated area correspond.

13. A chord indication method of indicating string stopping positions for playing chords with plural kinds of stringed instruments, said method comprising the steps of:

designating a stringed instrument, for which said string stopping positions should be indicated, among said plural kinds of stringed instruments;

supplying a chord;

indicating string stopping positions corresponding to the supplied chord with respect to the designated stringed instrument; and sounding said chord to which the indicated string stopping positions correspond, in a timbre of the designated stringed instrument.

14. A mechanically-readable storage medium which stores commands to instruct an apparatus to execute a chord indication method of indicating string stopping positions for playing chords with plural kinds of stringed instruments, said method comprising the steps of:

storing, in a storage device, table data in which string stopping positions are indicated for a variety of chords with respect to said plural kinds of stringed instruments;

designating a stringed instrument, for which the string stopping positions should be indicated, among said plural kinds of stringed instruments;

supplying a chord; and retrieving table data corresponding to the designated stringed instrument from plural kinds of table data stored in said storage device and acquiring string stopping positions corresponding to the supplied chord from the retrieved table data.

15. A mechanically-readable storage medium which stores commands to instruct an apparatus to execute a chord indication method of indicating string stopping positions for playing a chord with plural kinds of stringed instruments, said method comprising the steps of:

designating a stringed instrument, for which said string stopping positions should be indicated, among said plural kinds of stringed instruments;

supplying a chord;

indicating string stopping positions corresponding to the supplied chord with respect to the designated stringed instrument; and selectively setting a first mode in which a capotasto position can be set or a second mode in which the capotasto position cannot be set;

wherein if said first mode in which said capotasto position can be set is set, said string stopping positions are changed according to the set capotasto position and string stopping positions changed from said string stopping positions are indicated, and if said second mode in which said capotasto position cannot be set is set, said string stopping positions are indicated directly without changing said string stopping positions.

16. A mechanically-readable storage medium which stores commands to instruct an apparatus to execute a chord indication method of indicating string stopping positions for playing chords with plural kinds of stringed instruments, said method comprising the steps of:

designating a stringed instrument, for which said string stopping positions should be indicated, among said plural kinds of stringed instruments;

supplying a chord;

indicating, in a predetermined area, the string stopping positions corresponding to the supplied chord with respect to the designated stringed instrument by displaying said string stopping positions;

pointing said predetermined area; and sounding musical tones of said chord to which said string stopping positions indicated in the designated area correspond.

17. A mechanically-readable storage medium which stores commands to instruct an apparatus to execute a chord indication method of indicating string stopping positions for playing chords with plural kinds of stringed instruments, said method comprising the steps of:

designating a stringed instrument, for which said string stopping positions should be indicated, among said plural kinds of stringed instruments;

supplying a chord;

indicating string stopping positions corresponding to the supplied chord with respect to the designated stringed instrument; and sounding said chord to which the indicated string stopping positions corresponding, in a timbre of the designated stringed instrument.

* * * * *